US007850237B2

(12) United States Patent
Gorgi

(10) Patent No.: US 7,850,237 B2
(45) Date of Patent: Dec. 14, 2010

(54) DEVICE FOR ADJUSTING THE RECLINING FORCE IN OFFICE CHAIR MECHANISMS

(75) Inventor: Claudio Gorgi, Rossano Veneto (IT)

(73) Assignee: IMARC S.p.A., Rossano Veneto ( * ) Notice: Subject to any disclaimer, the term of this patent is extended or adjusted under 35 U.S.C. 154(b) by 345 days.

(21) Appl. No.: 11/919,404

(22) PCT Filed: Apr. 24, 2006

(86) PCT No.: PCT/EP2006/003736

§ 371 (c)(1),
(2), (4) Date: Oct. 26, 2007

(87) PCT Pub. No.: WO2006/114250

PCT Pub. Date: Nov. 2, 2006

(65) Prior Publication Data

US 2009/0302655 A1 Dec. 10, 2009

(30) Foreign Application Priority Data

Apr. 28, 2005 (IT) ..... 2005A0027

(51) Int. Cl.
*A47C 1/024* (2006.01)
*A47C 3/00* (2006.01)

(52) U.S. Cl. ..... 297/303.1; 297/303.4

(58) Field of Classification Search ..... 297/303.4, 297/303.1, 303.3, 303.5
See application file for complete search history.

(56) References Cited

U.S. PATENT DOCUMENTS

| | | | | |
|---|---|---|---|---|
| 4,744,600 | A * | 5/1988 | Inoue | 297/303.4 |
| 4,858,993 | A * | 8/1989 | Steinmann | 297/303.4 X |
| 6,712,428 | B2 * | 3/2004 | Moreschi | 297/303.4 |
| 7,080,884 | B2 * | 7/2006 | Daeschle et al. | 297/303.4 |
| 2004/0195883 | A1 * | 10/2004 | Vrijlandt et al. | 297/303.4 X |

FOREIGN PATENT DOCUMENTS

| | | |
|---|---|---|
| EP | 1 258 211 | 11/2002 |
| EP | 1 258 212 | 11/2002 |

* cited by examiner

*Primary Examiner*—Anthony D Barfield
(74) *Attorney, Agent, or Firm*—Stein McEwen, LLP

(57) ABSTRACT

A device for adjusting the reclining force in office chair mechanisms comprising at least two mutually hinged parts and elastic means (16) which maintain said parts elastically spaced apart, said device being characterized by comprising:—at least two levers (7, 6), at least one of which interacts with said elastic means (16) and the other of which is connected to one of said hinged parts, said levers respectively interacting via at least one movable contact element (13) by way of contact surfaces,—means (9, 10, 14) for adjusting the position of said movable contact element (13) such as to modify the points at which said movable contact element bears on said contact surfaces and consequently such as to modify the lever arms.

4 Claims, 4 Drawing Sheets

DEVICE FOR ADJUSTING THE RECLINING FORCE IN OFFICE CHAIR MECHANISMS

The present invention relates to a device for adjusting the reclining force in office chair mechanisms.

Various mechanism adjustment devices for modifying the reclining force according to the user's physique and taste have already been proposed, however they mostly act on the spring preload.

If compression springs are used, an adjustment knob disposed coaxially to the spring is operated. If torsion springs are used, the preload is varied by using elements which pull or push the free end of the spring (schematically shown in FIG. 1).

The main drawback of this system is that the preload adjustment cannot be too large otherwise insurmountable problems arise regarding the spring reliability and the compactness of the chair design. Moreover to overcome the spring force during the adjustment an always critical compromise must be reached between the physical force and the gearing-down (number of screw turns) required to make the adjustment. However the main drawback from the ergonomic viewpoint is that due to the fact that although the load on the chair may increase, the force increase during reclining is constant. Essentially, a "light" user encounters excessive reclining hardness, whereas for a "heavy" user it is totally insufficient.

Other preload adjustment systems also exist, such as WO02058514 or EP0934716 (schematically shown in FIG. 2). These are not based on direct adjustment of the length of the preloaded spring, or at least not only. They use adjustments which vary the preload during reclining by increasing or decreasing the distance through which the spring travels. For example, EP0934716 modifies the position of the fulcrum of the element on which the spring is mounted, which during chair reclining undergoes a different compression. In the same manner, WO02058514 achieves a greater or lesser spring extension on varying the position of the adjustment cam. Although this effect allows easier and quicker adjustment, these systems do not solve the problem of the limited adjustment range and enable the chair rigidity to be only partially varied.

Other solutions have been proposed which, although utilizing this travel gearing effect, are based more on varying the point on which the spring rests, so modifying the levers in play (for example U.S. Pat. Nos. 4,981,326, 5,564,783, EP1175854, WO9423614, EP1440632, schematically represented in FIG. 3). In this category the adjustment is obtained substantially by modifying the lever formed between a movable element of the chair, often its backrest, the rotation fulcrum, and the point at which the elastic resistance is applied.

This system is very valid from the ergonomic viewpoint because it enables a large adjustment range to be achieved. However a compromise has again to be made, as the need for compactness of the mechanism structure is hardly compatible with large movements of large dimension springs.

In other cases the position of the spring during adjustment has been able to be left substantially unvaried in order to reduce bulk, by interposing a connecting rod which always transfers the load to the point to which the spring is fixed (for example U.S. Pat. No. 6,394,549, EP1258212, schematically represented in FIG. 4). However insuperable difficulties are still encountered both in overcoming all friction and achieving the necessary ease of adjustment, and because of the constructional complexity of the control.

An object of the invention is to eliminate these drawbacks by providing an adjustment device which is compact, sufficiently economical and of very advanced ergonomics, by virtue of the fact that adjustment is easy and very extensive for both very light and very heavy users.

This and further objects which will be apparent from the ensuing description are attained by a device for adjusting the reclining force in office chair mechanisms as described in claim 1.

The present invention is described in detail hereinafter with reference to the accompanying drawings, in which.

Figure 1:
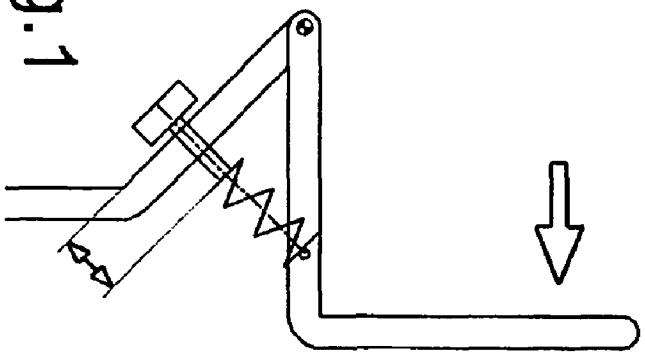
FIGS. 1-4 show the operating schemes of devices of the known art.
Figure 2:
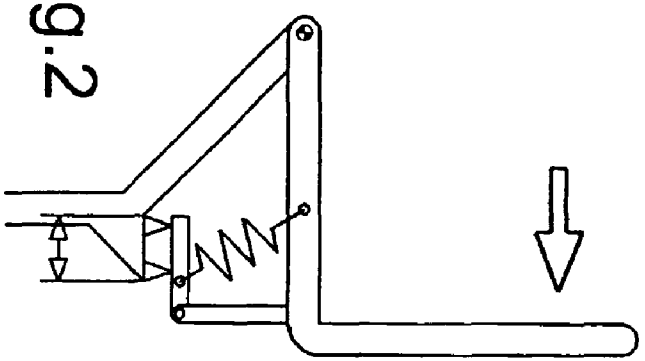
Figure 3:
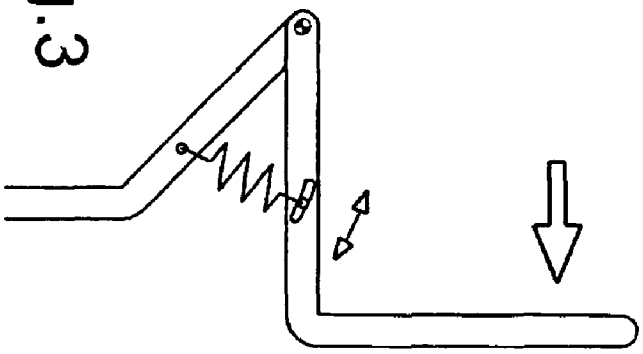
Figure 4:
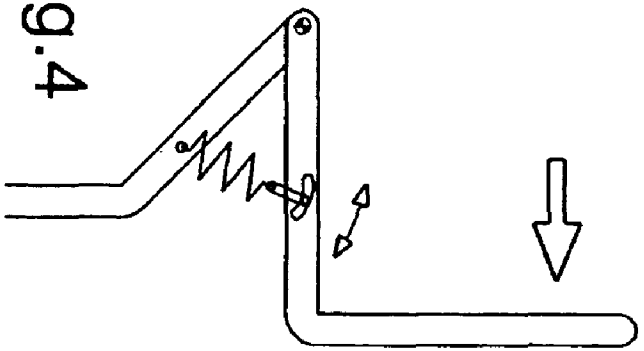

As can be seen from FIGS. 7-10, the adjustment device of the invention is applied to an office chair mechanism consisting of a reclining support comprising a fixed box structure 1 provided lowerly with a frusto-conical bush for insertion of the upper end of the stem of a traditional gas spring (not shown in the drawings) the purpose of which is to support the reclining mechanism on a support base.

A connection element 4, connected to the box structure 1, connects the fixed structure 1 to a plate element 3 rigid with the chair by means of pins 21 and 23. A movable element 2 is rigid with the backrest (not shown) and is pivoted to the fixed box structure by a pin 5, and to the element 3 rigid with the chair by a pin 22.

To the box structure 1 there is fixed a pivot pin 8 for a lever 7 provided with a bearing surface 11 and having its free end acting on a spring 16, the other end of which is secured to the fixed box structure 1.

A profiled portion 6 rigid with the element 2 presents a surface 12 which when the mechanism is in its upper position is parallel to the surface 11 of the lever 7.

Between the bearing surface 12 of the profiled portion 6 and the surface 11 of the lever 7 there is interposed a pin 13 inserted through a slotted hole 14. This slotted hole 14 is provided in a plate 9 provided with an operating handle 10 and is shaped to form a curvature eccentric to the pivot pin 8 of the plate 9.

The slotted hole 14 is also provided with a plurality of notches defining stable positions 15 for the pin 13.

Figure 5:
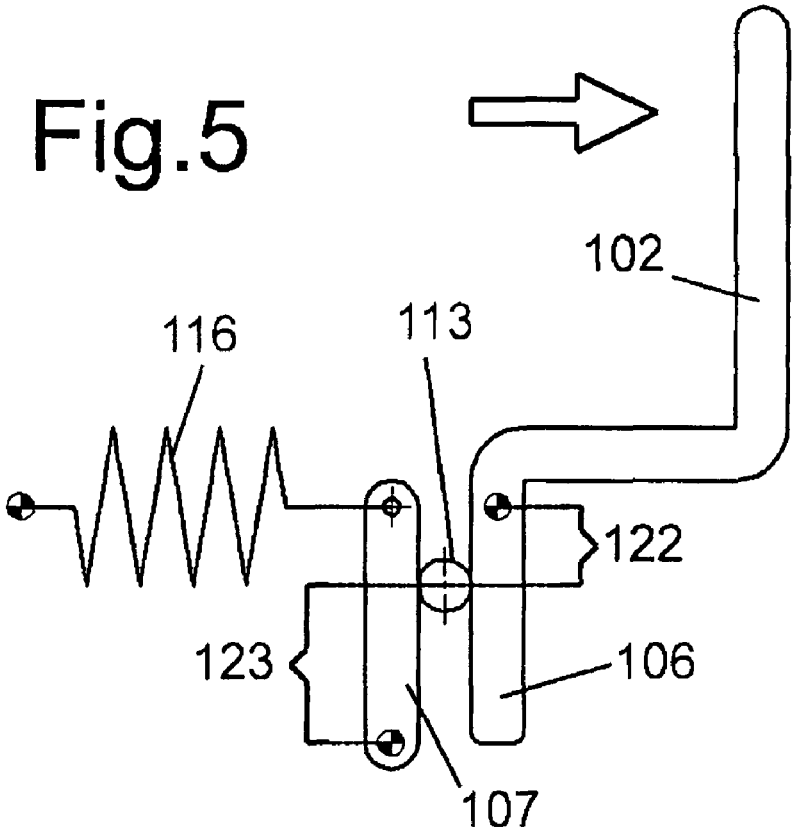
FIGS. 5-6 show the operating scheme of the adjustment device.

The principle of operation of the device according to the invention is shown schematically in FIG. 5, which shows two opposing levers 106 and 107 connected together by a bearing element 113, the adjustable position of which simultaneously modifies the arms 122 and 123 of both levers, so that if one increases the other decreases. In this manner, small movements of the bearing element produce considerable multiplication of the lever effort between the power element consisting of the backrest 102 and the resisting element consisting of the spring 116. In this respect, if a force is applied to the power element 102 it is transferred via the arm 122 to the bearing element 113 and from there, via the arm 123, to the resisting element 116. In the second scheme the position of the element 113 has been varied to reduce the lever arm 123 and increase the lever arm 122. Hence to overcome the force of the spring 116 of the system adjusted in this manner, a much higher force is required on the power element 102.

Figure 6:
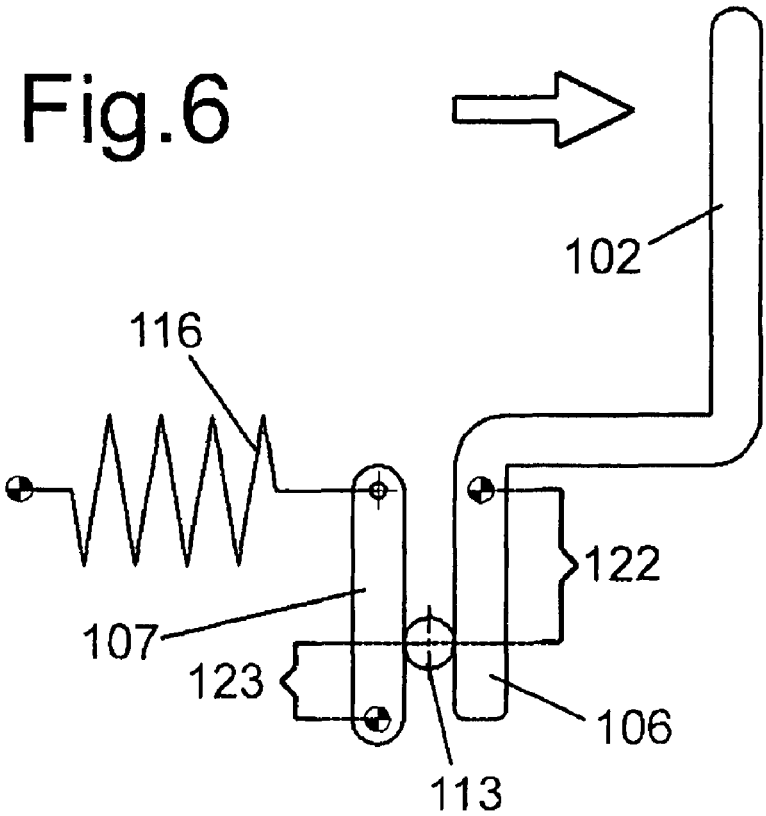
Figure 7:
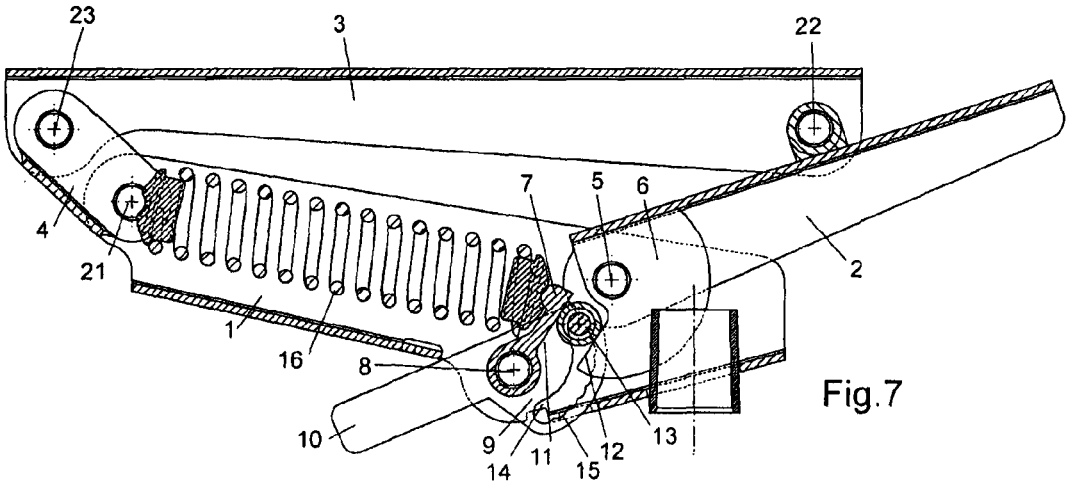
FIG. 7 is a section through the device in its upper position with minimum adjustment.
Figure 8:
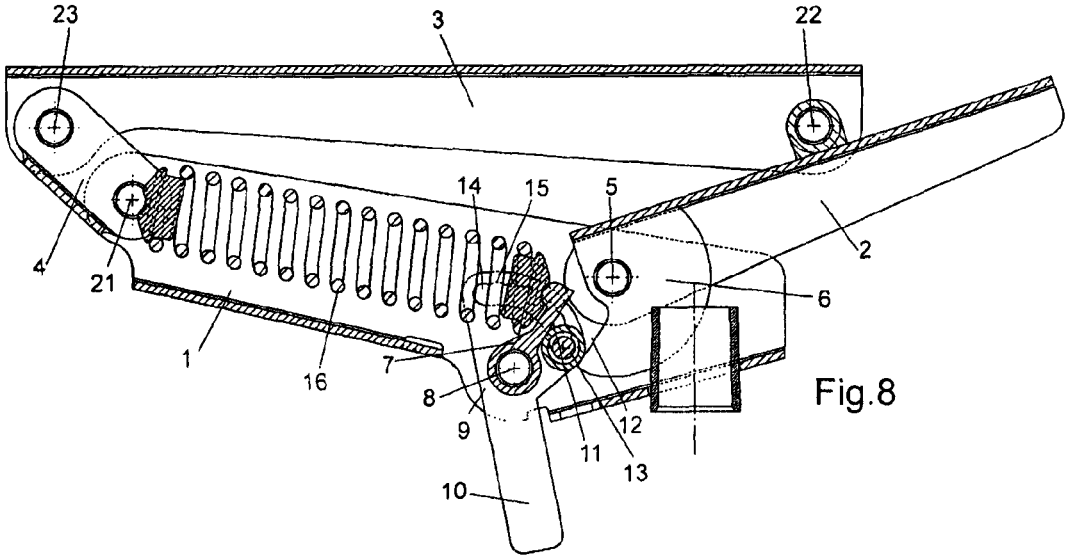
FIG. 8 is a section through the device in its upper position with maximum adjustment.

With regard to the device represented in FIGS. 7-10, its operation is as follows, bearing in mind that that which in FIGS. 5-6 was the lever 107 connected to the spring 116 has now become the lever 7. The other lever 106 of the scheme is represented by the profiled portion 6 of the movable element rigid with the backrest 2. The bearing element 13 is interposed between the two levers to transfer the forces from one lever to the other by acting via the bearing surfaces 11 and 12. The purpose of the element formed by the plate 9 with the handle 10 is to adjust the position of the bearing element 13 between the two levers along the respective bearing surfaces and to maintain the position of the pin 13 fixed relative to the element 2 during reclining. To facilitate adjustment, the bearing surfaces 11 and 12 are parallel when in the upper position. In this manner no force is required to rotate the handle 10 which acts on the bearing pin 13, because the levers 6 and 7 do not move.

Hence adjustment is achieved by rotating the plate 9 by acting on the lever 10. The bearing pin 13, compelled by the shape of the cam slot 14, consequently moves along the bearing surfaces 11 and 12. In this respect, as the angle of the mechanism varies, the lever 6, rigid with the backrest, urges the bearing pin 13 which itself urges the second lever 7 connected to the spring 16. As can be seen from FIGS. 9 and 10, depending on the adjustment and hence on the position of the pin between the two levers, two effects are obtained, both very important for modifying the force on the backrest.

Figure 9:
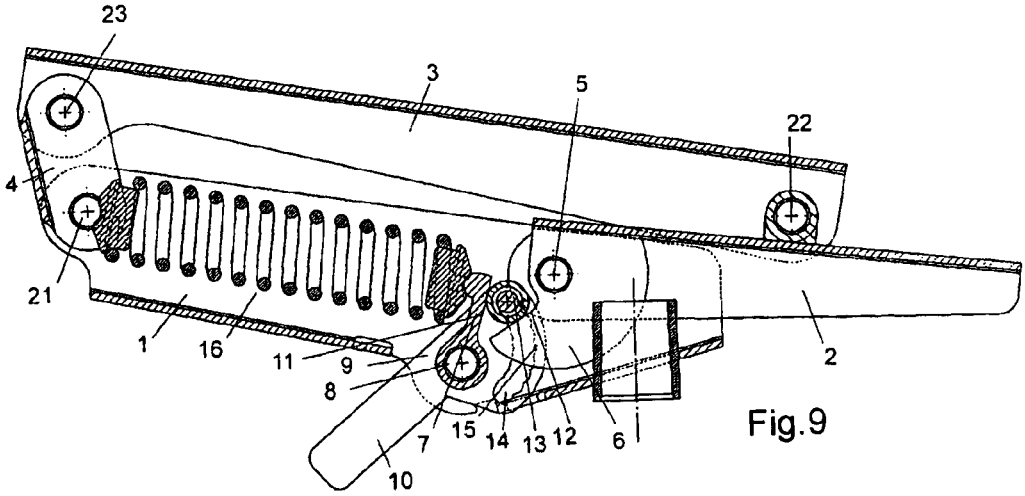
FIG. 9 is a section through the device in its lower position with minimum adjustment.
Figure 10:
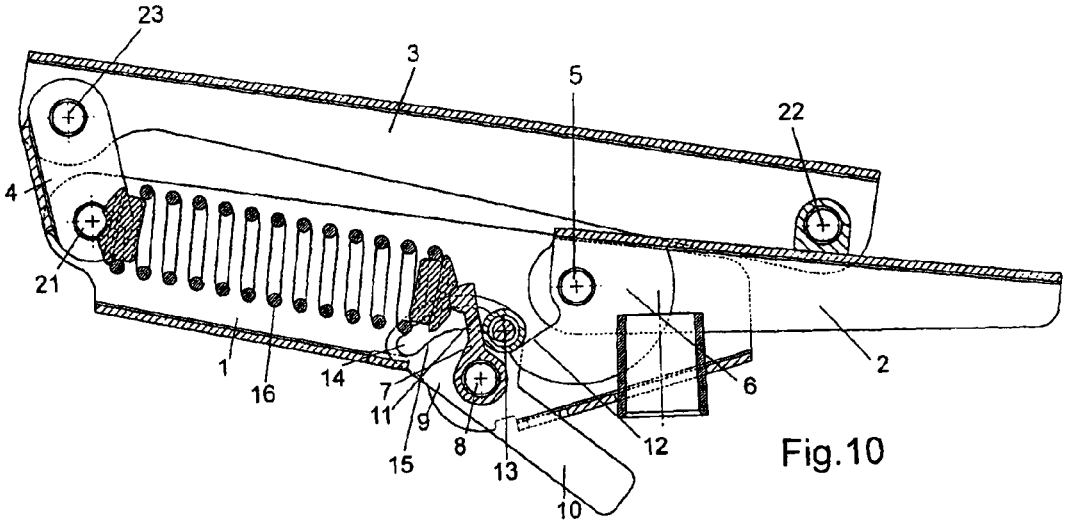
FIG. 10 is a section through the device in its lower position with maximum adjustment.

The first effect is that when the mechanism is in its lower position the spring is pressed much more in the case of FIG. 10 than in the case of FIG. 9, so increasing the load on the spring.

The second effect, even more important than the first, is that the arms of the two levers are varied such that the effective torque transferred to the backrest is much higher in FIG. 10 than in FIG. 9.

The synergic effect of the two effects makes this adjustment system very powerful.

It is also made very versatile by the facility to optimize the geometries of the levers and controls. In this respect, by modifying the relative position of the fulcrums, bearing points and controls, different force transfers can be obtained both by virtue of the different directions of the force vectors between the various components and by virtue of the rolling of the bearing pin along the contact surfaces, which also modifies the lever arms during reclining.

The operation of the system does not change if instead of compression springs, elastic elements of a different type are used, such as tension springs. In the same manner it does not change if instead of operating by bearing on a pin, the levers operate under traction, for example within slots, or if instead of the bearing pin another system is used for force transfer, for example connecting rods or gears.

From the aforegoing it is apparent that the device of the invention presents numerous advantages, and in particular:

- chair versatility in that a mechanism is obtained with very wide force adjustment,
- very valid ergonomics as the adjustment is simple and rapid.
- lesser constructional complexity than similar devices and hence less costly,
- a compact mechanism design resulting in improved chair appearance.

The invention claimed is:

1. A device for adjusting the reclining force in office chair mechanisms, comprising:

- two mutually hinged parts and elastic means which maintain said parts resiliently spaced apart;
- a pair of levers, the first one of said pair of levers located on one of said hinged parts and interacting with said elastic intersecting means, and the second one of said pair of levers connected to the other one of said hinged parts;
- a first contact surface located on one of said levers and a second contact surface located on the other one of said levers;
- said contact surfaces being parallel to one another and facing one another;
- a contact element movable along said contact surfaces; and
- means for adjusting the position of said contact element to modify the points at which said contact element bears simultaneously on said contact surfaces to contemporaneously modify the effective lengths of the arms of said pair of levers.

2. The device as recited in claim 1 wherein said contact element comprises a pin, and said means for adjusting said movable contact element comprises a plate, a slotted hole formed in said plate, and operating handle for said plate, said pin constrained by said slotted hole.

3. The device as recited in claim 2 wherein a plurality of notches is formed within said slotted hole is curved in shape, and each notch defines a different stable position for said pin.

4. The device as defined in claim 1 wherein said second contact surface is defined by a profiled portion on said second lever.

* * * * *